United States Patent [19]

Gringer

[11] 4,359,158

[45] Nov. 16, 1982

[54] BLISTER PACK FOR STORAGE AND DISPLAY OF ELONGATED ARTICLES AND THE LIKE

[76] Inventor: Donald Gringer, 1513 Olmstead Ave., New York, N.Y. 10462

[21] Appl. No.: 255,445

[22] Filed: Apr. 20, 1981

[51] Int. Cl.[3] ..... A45C 11/26

[52] U.S. Cl. ..... 206/349; 206/461

[58] Field of Search ..... 206/461, 467, 468, 469, 206/470, 443, 361, 362, 352, 351, 379, 376, 349

[56] References Cited

U.S. PATENT DOCUMENTS

| | | | |
|---|---|---|---|
| 2,195,577 | 4/1940 | Miles | 206/461 |
| 3,055,492 | 9/1962 | Franklin et al. | 206/361 |
| 3,770,120 | 11/1973 | Hanson | 206/461 |
| 3,885,667 | 5/1975 | Spiegel et al. | 206/461 |
| 4,039,079 | 8/1977 | Laughton | 206/461 |
| 4,165,805 | 8/1979 | Fethke et al. | 206/461 |
| 4,179,029 | 12/1979 | Fethke et al. | 206/461 |

FOREIGN PATENT DOCUMENTS

| | | | |
|---|---|---|---|
| 1325068 | 3/1933 | United Kingdom | 206/461 |

*Primary Examiner*—Joseph Man Fu Moy
*Attorney, Agent, or Firm*—Hubbell, Cohen, Stiefel & Gross

[57] ABSTRACT

A blister pack structure for the storage and display of articles, especially elongated articles, said blister pack comprising a relatively stiff backing sheet serving as a substrate upon which the elongated article is supported and a transparent cover sheet having marginal portions thereof affixed to said substrate and defining an enclosure for receiving at least a portion of said article. The configuration of the enclosure substantially conforms to the outline of said article. The length of the article is greater than the length of the enclosure whereby one end of the article extends into the enclosure while the opposite end of the article extends beyond one end of the enclosure to facilitate and in fact encourage handling of the exposed portion of the article. Fastening means affixed to the enclosure retains the article within the package and prevents inadvertent removal of the article from the enclosure.

9 Claims, 3 Drawing Figures

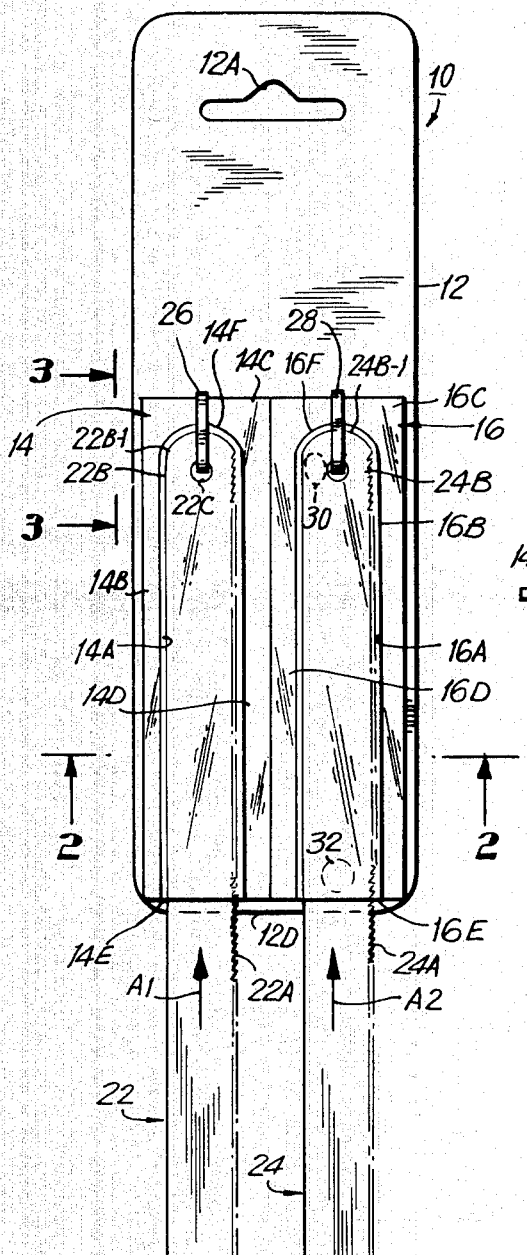
FIG. 1
FIG. 2
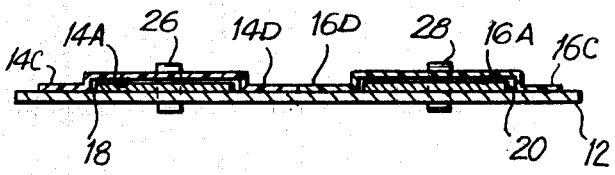
FIG. 3
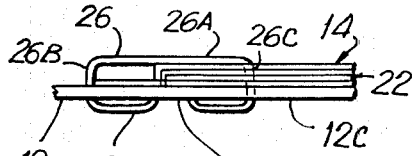

BLISTER PACK FOR STORAGE AND DISPLAY OF ELONGATED ARTICLES AND THE LIKE

FIELD OF THE INVENTION

The present invention relates to packages and, more particularly, to point of sale packages of the blister pack type especially adapted for packaging and display of elongated articles.

BACKGROUND OF THE INVENTION

Packages of the blister pack type have gained wide popularity due to their simplicity of design, their economy of production, and further due to the fact that they provide unimpeded viewing of the contents of the blister pack, serving as an inducement to purchasers at the very point of sale. Blister packs typically comprise a substantially dish-shaped plastic sheet which defines a recess adapted to receive the article, or articles, to be contained therein and having a continuous flange surrounding the aforesaid recess. The continuous flange is affixed to a cover sheet preferably formed of a stiff paper board or cardboard sheet, the flange being affixed thereto by heat-sealing, stapling or a suitable epoxy or adhesive. The cover sheet substantially completely seals the recess so that the transparent sheet and cover member cooperate to substantially completely surround the article, or articles, contained therein.

The transparent member may be formed of a relatively rigid plastic material, having a shape that may or may not conform to the shape of the contents and defining an interior region which enables the contents to experience at least some free movement therein. Alternatively, the transparent sheet may be of the shrink wrap type which is affixed to the aforementioned cover sheet and which is then heat treated. Shrink wrap material of this type undergoes a significant amount of shrinkage as a result of the aforesaid heating, causing the shrink wrap material to draw itself tightly against the article contained therein and to follow the shape and contours thereof thereby providing a compact package of minimal package dimensions relative to the article itself.

The variety of articles which have been packaged in blister packs is legion. One category of items which have been advantageously packaged in blister packs comprise elongated articles and especially slender, elongated articles such as replacement saw blades. The blister pack utilized to package individual saw blades, for example, comprise a substrate or cover sheet formed of an elongated relatively stiff material such as paper board and dimensionally at least slightly longer than the length of the saw blade and slightly wider than the width of the saw blade, which is positioned thereon to provide a continuous marginal portion of said substrate extending beyond the periphery of the saw blade. The transparent plastic sheet of the shrink wrap type is positioned upon the saw blade and is dimensionally of substantially the same size as said substrate and has its continuous marginal portion secured to the aforesaid marginal portion of said substrate. The transparent sheet is then treated to cause it to shrink and thereby be drawn tightly against the saw blade positioned between the substrate and the transparent sheet. The package neatly positions the saw blade and is more than adequate to retain the saw blade therein. However, the package has the disadvantage that it is wasteful of material since the substrate and the backing member must be dimensionally larger than the contents thereof in order to completely enclose the saw blade.

BRIEF DESCRIPTION OF THE INVENTION

The present invention is characterized by comprising a package of the blister pack type which retains substantially all of the advantages of conventional blister pack packages and which makes better economic use of the packaging material and which further permits and, in fact, encourages the actual handling of at least a portion of the packaged article serving as a further inducement to the sale thereof.

The present invention is characterized by comprising a backing sheet having a transparent sheet affixed thereto in much the same manner as conventional blister packs. However, although both the substrate and the transparent sheet are wider than the elongated article to be packaged therein, the length of the substrate and the transparent sheet which, though being equal to one another, is substantially less than the length of the elongated article to be packaged therein so that only a portion of said article is enclosed within the blister pack package while the remaining portion of said article extends beyond one end of said package permitting the exposed portion thereof to be freely examined and even handled by a potential purchaser.

The elongated article is preferably restrained from being removed from the package by securement means, which may, for example, be a staple, rivet, grommet or other like fastening member, which is affixed to the package and extends through an opening or slot provided in the elongated article. Alternatively, the blade may be retained in the enclosure by a mitable glue or epoxy. The length of the blister pack package is shorter than the length of said elongated article and may, in fact, be less than one half, or even less than one quarter, the length of said elongated article thereby exposing as much as one half to three-quarters of said article as well as making economical use of the packaging material. The blister pack package may be provided with a mounting slot or opening or a mounting member to facilitate its being removably positioned upon a point of sale display rack, for example. One or more blades may be mounted upon the substrate, each within its own enclosure.

OBJECTS OF THE INVENTION AND BRIEF DESCRIPTION OF THE FIGURES

It is therefore one object of the present invention to provide a package of the blister pack type especially advantageous for use in packaging one or more slender, elongated articles and including securement means to adequately retain the article within the package, thus avoiding the need for completely enclosing the article.

Still another object of the present invention is to provide a package of the character described and which makes economic use of the packaging material.

The above, as well as other objects of the present invention, will become apparent when reading the accompanying description and drawing in which:

FIG. 1 shows a top plan view of a package embodying the principles of the present invention.

FIG. 2 shows a sectional view of the package of FIG. 1 looking in the direction of arrows 2—2 of FIG. 1; and FIG. 3 shows a side view of a portion of the package of FIG. 1 looking in the direction of arrows 3—3.

DETAILED DESCRIPTION OF THE INVENTION

FIGS. 1 though 3 show a package 10 embodying the principles of the present invention and comprised of a substrate 12 preferably formed of a relatively stiff material such as cardboard or stiff paperboard and having a generally rectangular shape. The upper end of substrate 12 is provided with a slot 12A to facilitate mounting of the package upon a point of sale display rack, for example. The lower portion of card 12 has mounted thereon first and second clear plastic sheets 14 and 16 each having a generally rectangular shape and each being provided with an elongated recess 14A, 16A bordered on three sides by a continuous flange comprised of flange portions 14B, 14C, 14D and 16B, 16C, 16D, all of which flange portions engage the top surface of substrate 12 and are secured thereto by a suitable epoxy or glue (not shown for purposes of simplicity). The recesses and flanges of transparent members 14 and 16 cooperate with substrate 12 to collectively form enclosures 18 and 20 for receiving articles to be packaged therein, namely, slender elongated saw blades 22 and 24 having cutting edges 22A and 24A respectively.

The enclosures 18 and 20 have open ends defined by the lower edges 14E and 16E of transparent sheets 14 and 16. Each blade 22, 24 is inserted into the package 10 by placing the upper end 22B, 24B in alignment with the open ends of enclosures 18 and 20 and then sliding the blades 22 and 24 in the direction shown by arrows A1 and A2, until their upper edges 22B-1, 24B-1 engage the end walls 14F, 16F of the recesses 14A, 16A formed in transparent sheets 14 and 16.

In order to retain each saw blade 22, 24 within its associated enclosure 18, 20, a fastening member such as, for example, a staple 28 may be utilized. Since each saw blade 22, 24 is secured within the package 10 in substantially identical fashion, only one such fastening assembly will be described herein in detail for purposes of simplicity. Noting FIG. 3, staple 26 is shown as having a central portion 26A overlying the upper end of transparent sheet 14 and having one arm thereof piercing through substrate 12 and bent so that free end 26B-1 firmly engages the underside 12C of substrate 12. The remaining arm 26C of staple 26 pierces through transparent sheet 14, extends through an opening 22C in saw blade 22 and pierces through substrate 12. Arm 26C is bent so that its free end 12C-1 intimately engages the underside 12C of substrate 12. The staple 28 is preferably mounted upon the package 10 by an automatic process utilizing a conventional stapling gun (not shown), for example, providing a simple, inexpensive technique for securing each blade 22, 24 within its associated enclosure 18, 20 respectively. If desired, other mechanical fastening means may be employed, such as a rivet, for example.

As another alternative arrangement, a dab 30 of an epoxy or glue may be applied to one or both surfaces of each blade, such as for example blade 24, prior to insertion into enclosure 20, to retain blade 24 within enclosure 20. A dab of glue may be placed on both surfaces of blade 24 and, if desired, may be placed a spaced distance inward from the upper end of blade 24 as shown, for example, at 32 to secure blade 24 within enclosure 20 and in the region immediately adjacent edge 16E of transparent member 16.

Although package 10 shows an arrangement in which two saw blades 22, 24 are mounted therein, it should be understood that the package 10 may be modified to accommodate more or less than two blades within the package 10, without departing from the spirit or scope of this invention. In addition, if desired, the transparent sheets 14 and 16 may be of the shrink wrap type and may be appropriately treated by heat, infrared radiation, or the like to cause the sheets 14 and 16 to shrink and thereby be drawn into intimate contact with their associated blades 22 and 24 to further enhance the securement of each blade 22, 24 within its associate enclosure 18, 20.

As can clearly be seen from FIG. 1, a substantial portion of each blade 22, 24 preferably greater than one-half the length thereof, extends beyond the lower end 12D of package 10 to permit and, in fact, encourage potential purchasers to make closer observation and, in fact, even touch and feel the blade members 22 and/or 24 without disturbing the integrity of the package 10, which capability is not possible in conventional shrink wrap packages or blister packs. Since a small portion of each of the blades 22, 24 is enclosed is package 10, the members 14 and 16 need not be transparent and may be only partially transparent, translucent or even opaque, since such a large part of the article is exposed to view.

Although the preferred embodiment shows the package adapted for receiving replacement saw blades, it should be understood that the package 10 of the present invention may be utilized to enclose any slender elongated article, such as rulers, files, and the like.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A package for packaging at least one slender elongated article having an associated longitudinal extent, said package comprising:

a backing member comprising a substrate formed of a relatively stiff sheet, said backing member having a longitudinal extent substantially less than the associated longitudinal extent of said one slender elongated article, said one slender elongated article having a distal end and a proximal end with said distal end of the packaged slender elongated article extending substantially beyond the longitudinal extent of said backing member; an open ended blister pack positioned on said backing member substrate comprising three contiguous sides forming a U-shaped margin joined to said backing member substrate for defining a slender open-ended blister pack enclosure region on said backing member substrate for the proximal end of said one slender elongated article, said distal end of said packaged slender elongated article extending outwardly from said open-ended blister pack substantially beyond the longitudinal extent of said backing member; and removable fastening means removably insertable through said packaged proximal end of said one slender elongated article for removably securing said one packaged slender elongated article to said backing member in said open-ended blister pack, said removable fastening means extending through said open-ended blister pack, said one packaged article proximal end and said backing member; whereby said removable fastening means facilitates removable retention of said one packaged article proximal end to said backing member within said open-ended blister pack while said open-ended blister pack facilitates lateral retention of said fastened one packaged article proximal end to said backing member.

2. The package of claim 1 wherein said blister pack is transparent.

3. The package of claim 1 wherein said fastening means comprises a mechanical fastening member.

4. The package of claim 3 wherein said mechanical fastening member is a staple.

5. The package of claim 1 wherein said article is a saw blade.

6. The package of claim 1 wherein said substrate comprises a sheet of cardboard.

7. The package of claim 1 wherein said substrate comprises a sheet of relatively stiff paperboard.

8. The package of claim 1 wherein said blister pack is formed of plastic material of the shrink wrap type.

9. The package of claim 1 wherein the interior dimensions of said open-ended blister pack are sufficient to facilitate said lateral retention of said one packaged slender elongated article proximal end while enabling removal of said one packaged slender elongated article from said open-ended blister pack open end when said fastening means is removed.

* * * * *